US005121092A

United States Patent [19]

Castonguay et al.

[11] Patent Number: 5,121,092

[45] Date of Patent: Jun. 9, 1992

[54] MOLDED CASE CIRCUIT BREAKER THERMAL-MAGNETIC TRIP ACCELERATOR

[75] Inventors: Roger N. Castonguay, Terryville; David Arnold, Chester, both of Conn.

[73] Assignee: General Electric Company, New York, N.Y.

[21] Appl. No.: 650,275

[22] Filed: Feb. 4, 1991

[51] Int. Cl.[5] ..... H01H 9/00

[52] U.S. Cl. ..... 335/172; 335/167

[58] Field of Search ..... 335/21-24, 335/35, 167-176

[56] References Cited

U.S. PATENT DOCUMENTS 3,377,574 4/1968 Brumfield et al. ..... 335/172
3,466,578 9/1969 Brumfield ..... 335/172
4,679,016 7/1987 Ciarcia et al. ..... 335/132
4,736,174 4/1988 Castonguay et al. ..... 335/167
4,913,503 4/1990 Castonguay et al. ..... 335/172

*Primary Examiner*—Leo P. Picard
*Assistant Examiner*—Lincoln Donovan
*Attorney, Agent, or Firm*—Richard A. Menelly; Fred Jacob

[57] ABSTRACT

A trip accelerator interfaces the thermal-magnetic trip unit and the operating mechanism within a thermal-magnetic molded case circuit breaker for improved response to overcurrent conditions within an associated electrical distribution circuit. The trip accelerator is in the form of a trip lever rotatably mounted on the operating mechanism side frame and is reset by the operating mechanism upon displacement of the circuit breaker operating handle.

7 Claims, 2 Drawing Sheets

MOLDED CASE CIRCUIT BREAKER THERMAL-MAGNETIC TRIP ACCELERATOR

BACKGROUND OF THE INVENTION

Thermal-magnetic circuit breakers employ a pivotally-mounted bi-metal along with a pivotally-mounted magnetic armature to articulate the circuit breaker operating mechanism upon the occurrence of overcurrent conditions of predetermined magnitudes. When used within circuit breakers of increased ampere rating, corresponding larger thermal-magnetic trip units must be employed to safely respond to the increased steady state and overcurrent conditions.

U.S. Pat. No. 4,736,174 entitled "Molded Case Circuit Breaker Operating Mechanism" describes a common operating mechanism that is used over a wide range of ampere ratings for circuit breakers employing an electronic trip unit. The electronic trip unit provides an electrical signal to articulate the operating mechanism for separating the circuit breaker contacts. This allows the use of a rating plug which enables a single trip unit to be used over a wide range of circuit breaker ampere ratings.

The use of such electronic trip operating mechanisms within thermal-magnetic circuit breakers, would substantially reduce the inventory requirements with such thermal-magnetic trip units since a single operating mechanism would be used over a wide range of ampere ratings.

One example of a thermal-magnetic trip unit used within thermal-magnetic circuit breakers is found in U.S. Pat. No. 4,679,016 entitled "Interchangeable Mechanism for Molded Case Circuit Breaker". The thermal-magnetic trip unit provides complete circuit protection by responding to so-called "long-term" and "instantaneous" overcurrent conditions when used within an industrial-rated electrical distribution circuit.

U.S. Pat. No. 4,675,641 entitled "Rating Plug for Molded Case Circuit Breakers" describes a means for using a common thermal-magnetic trip unit such as described within the aforementioned U.S. Pat. No. 4,679,016 within a wide range of circuit breaker ampere ratings by the provision of thermally-variable rating plugs whereby the sensed circuit current through the thermal-magnetic trip unit remains within predetermined limits while the actual circuit current increases with increased ampere rating.

One purpose of the invention is to provide a trip accelerator in combination with the standard operating mechanism to render such operating mechanism usable with state-of-the-art thermal-magnetic trip units.

SUMMARY OF THE INVENTION

A trip accelerator interfaces between a thermal-magnetic trip unit and an operating mechanism to render the operating mechanism responsive to a wide range of circuit breaker ampere ratings. The trip accelerator is in the form of a pivotally-mounted trip lever that articulates the operating mechanism upon overcurrent conditions and becomes reset by the operating mechanism when the operating mechanism becomes reset.

DESCRIPTION OF THE PREFERRED EMBODIMENT

Figure 1:
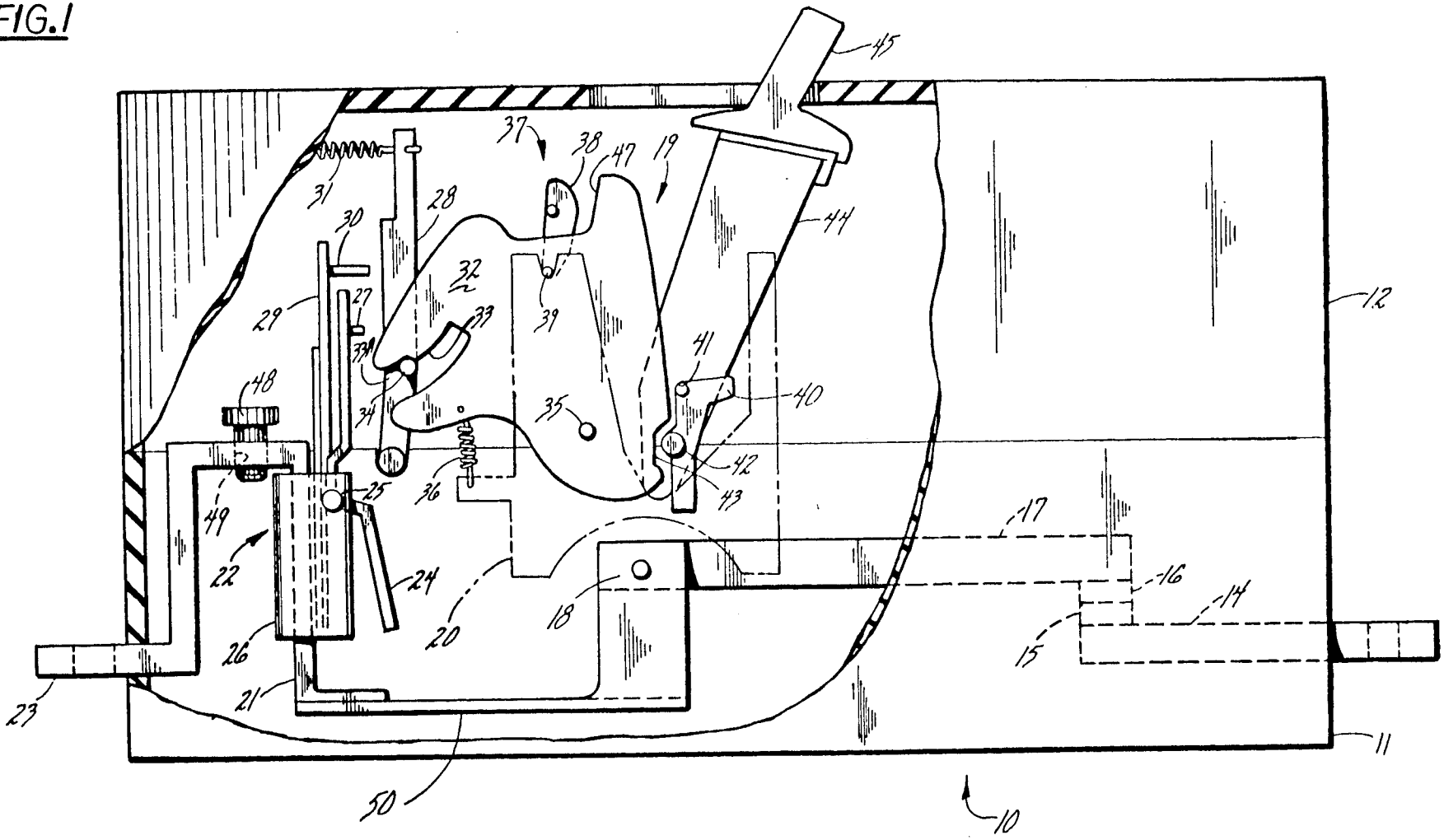
FIG. 1 is a side view in partial section of a thermal-magnetic circuit breaker employing the trip accelerator in accordance with the invention.

A thermal-magnetic circuit breaker 10 such as described within the aforementioned U.S. Pat. No. 4,679,016 is depicted in FIG. 1 with the thermal-magnetic trip unit 22 inverted such that both the magnetic trip post 27 and thermal trip post 30 are arranged on the same side of the trip unit. The thermal-magnetic circuit breaker consists of an insulative plastic case 11 to which a corresponding insulative plastic cover 12 is fixedly secured. The circuit current traverses through a line strap 14 arranged at the line-side of the circuit breaker and which connects with the fixed contact 15. The circuit current passes through the movable contact 16 which is arranged at one end of the movable contact arm 17 and which rotates about the crossbar pivot 18.

An operating mechanism 19 such as described in the aforementioned U.S. Pat. No. 4,736,174 controls the position of the fixed and movable contacts depending upon the magnitude of the circuit current. The circuit current is sensed within the thermal-magnetic trip unit 22 by transfer of the current from the movable contact arm to a heater 21 by connection with a conductive strap 50. The circuit is completed by connection between the heater and the load strap 23 located at the load end of the circuit breaker. The thermal-magnetic trip unit is similar to that described within the aforementioned U.S. Pat. No. 4,679,016 wherein an armature 24 pivotally attached to a stator 26 by means of a pivot pin 25 responds to severe overcurrent conditions to drive the magnetic trip post 27 into contact with the trip bar 28 to articulate the operating mechanism 19 in a manner to be described below in greater detail. The bi-metal 29 responds to less severe overcurrent conditions to correspondingly drive the thermal trip post 30 against the trip bar to articulate the circuit breaker operating mechanism in a similar manner. The latching system 37 which includes a secondary latch 38 is pivotally-mounted to the operating mechanism side frame 20 by means of a pivot post 39 and operates in the manner described within aforementioned U.S. Pat. No. 4,736,174 to release the operating mechanism and to allow the operating springs (not shown) to drive the movable contact arms 17 to the open position shown in FIG. 2 and thereby separate the fixed and movable contacts 15, 16. In accordance with the invention, a trip accelerator in the form of a trip lever 32 is connected with the operating mechanism side frame 20 by means of a pivot pin 35. A post 34 on the trip bar 28 engages the latch surface 33A of a slot 33 formed on the trip lever 32 on one side of the pivot pin 35 and is retained by the bias provided by the trip bar return spring 31. The trip lever spring 36 connecting between the trip lever and the operating mechanism side frame 20 biases the trip lever in the counterclockwise direction about the pivot pin 35. With the circuit breaker operating handle 45, which connects with the operating mechanism 19 by means of the handle yoke 44, in the "closed" position, shown in FIG. 1 the fixed and movable contacts 15, 16 allow the circuit current to transfer through the circuit breaker in the manner described earlier. The secondary latch 38 sits within the slot 47 formed within the top of the trip lever 32 and the circuit breaker remains in the so-called "latched" position. A driver or reset lever 40 such as described in U.S. Pat. No. 4,913,503 entitled "Molded Case Circuit Breaker Actuator-Accessory Unit Reset Mechanism" is attached to the operating mechanism side frame 20 by means of a pivot pin 41 and is arranged such that the post 42 on the driver lever is away from the slot 43 formed on the opposite side of the pivot pin 35 from the slot 33 on the trip lever 32. When the circuit breaker operating mechanism has responded to separate the circuit breaker contacts, the driver lever 40 later cooperates with the circuit breaker operating handle 45 to latch the operating mechanism and allow the movable contact arm 17 to drive the movable contact 16 against the fixed contact 15 to close the circuit breaker contacts when the operating handle is translated to the ON position depicted in FIG. 1.

Figure 2:
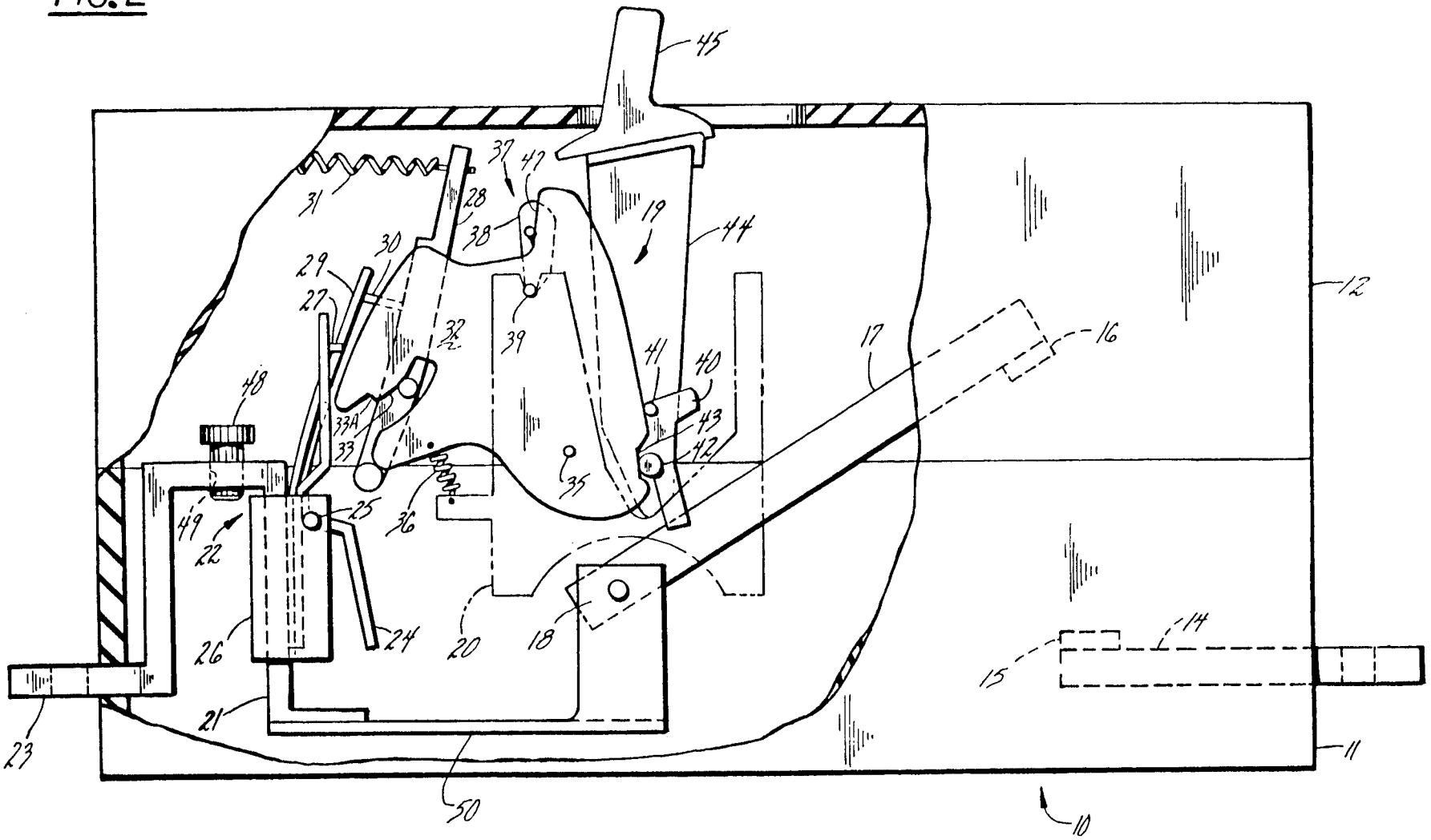
FIG. 2 is a side view in partial section of the circuit breaker of FIG. 1 depicting the thermal-magnetic trip unit and operating mechanism in their tripped position.

The circuit breaker 10 is shown in FIG. 2 with the movable contact arm 17 in the "TRIPPED" position and With the movable contact 16 separated from the fixed contact 15 within the case 12 and cover 11. A trip occurrence was caused by a so-called "long-term" overcurrent condition which drove the thermal trip post 30 on the bi-metal 29 against the trip bar 28 rotating the trip bar in the clockwise direction and releasing the associated post from engagement with the latch surface 33A of the slot 33 on the trip lever 32. The trip lever 32 is correspondingly rotated in the counterclockwise direction about pivot pin 35 under the urgence of the trip lever spring 36 which summarily drives the edge of the slot 47 against the secondary latch 38 rotating the secondary latch counterclockwise about the pivot post 39 as indicated. This unlatches the secondary latch 38 and the operating mechanism 19 and accordingly drives the movable contact arm 17 to the "TRIPPED" position and the operating handle 45 to its "TRIPPED" position. It is noted that the trip lever 32 allows the operating mechanism described within the aforementioned U.S. Pat. No. 4,736,174 to be used with the thermal-magnetic trip unit to effectively separate the circuit breaker contacts in an efficient manner. With the contacts separated and with the trip lever in the TRIPPED position, the post 42 on the driver lever 40 now contacts the surface of the slot 43 on the trip lever 32. When the operating handle 45 is later rotated to its counterclockwise "OFF" position during the RESET operation, the post 42 on the driver lever 40 attached to the driver lever by the pivot pin 41 is carried by the handle yoke 44 in the counterclockwise direction striking the trip lever 32 and now driving the trip lever clockwise about its pivot 35 away from the secondary latch 38 and back against the post on the trip bar 28. When the operating handle 45 is now rotated in the clockwise direction to close the circuit breaker contacts as indicated in FIG. 1, the trip lever 32 remains in the latched position. This occurs by virtue of the trip bar post being returned into engagement with the latch surface 33A under the return bias of the trip bar return spring 31 thereby stopping the counterclockwise rotation of the trip lever 32 against the bias of the trip lever spring 36. The circuit breaker is now operational such that the contacts are closed as shown in FIG. 1, and the thermal-magnetic trip unit 22 is back to its steady state position awaiting the occurrence of the next overcurrent condition.

In the event that a thermal rating plug, such as described within the aforementioned U.S. Pat. No. 4,675,641, is used with the circuit breaker 10 as depicted in FIGS. 1 and 2 wherein a thermal shunt 48 is inserted within the threaded slot 49 formed within the load strap 23, a standard thermal-magnetic trip unit 22 can be used over a wide range of circuit breaker ampere ratings as described in the aforementioned rating plug patent.

Having thus described our invention, what we claim as new and desire to secure by Letters Patent is:

1. A molded case circuit breaker comprising:

a plastic case and cover;

an operating mechanism within said case, said operating mechanism including a latch lever restraining said operating mechanism from separating a pair of contacts during quiescent current conditions within a protected circuit;

an operating handle extending though said cover at one end and connecting with said operating mechanism by means of a handle yoke at an opposite end, said operating handle opening and closing said contacts during said quiescent current conditions;

a thermal-magnetic trip unit within said case and arranged for displacing a trip bar and articulating said trip unit to separate said contacts upon occurrence of overcurrent conditions through said protected circuit; and a trip lever interfacing between said trip bar and said latch lever whereby said trip lever displaces said latch lever when said thermal-magnetic trip unit displaces said trip bar to articulate said operating mechanism and separated said contacts, said trip lever including a front slot at a front end receiving a trip post on said trip bar and thereby restraining said trip lever from rotating under rotation provided by a trip lever spring.

2. The circuit breaker of claim 1 wherein a latch surface on said slot contacts said trip post and restrains said trip lever from rotating against rotational bias provided by said trip lever spring.

3. The circuit breaker of claim 2 including a top slot at a top end of said trip lever receiving said latch lever whereby an edge of said top slot strikes said latch lever thereby displacing said latch lever when said trip post is displaced from said latch surface.

4. The circuit breaker of claim 3 including a reset lever rotatably mounted on said handle yoke within said case proximate a rear end of said trip lever, said reset lever interacting with said trip lever to reset said trip lever when said operating handle is translated to reset said operating mechanism.

5. The circuit breaker of claim 4 including a rear slot at said rear end of said trip lever, said rear slot receiving a reset post extending from said reset lever.

6. The circuit breaker of claim 4 wherein said reset post contacts a surface within said rear slot to rotate said trip lever back to an initial position.

7. The circuit breaker of claim 1 including rating means interchangeably connecting with said electro-magnetic trip unit whereby said electro-magnetic trip unit is operable over a range of current ratings.

* * * * *